US008683645B2

(12) United States Patent
Glassman

(10) Patent No.: US 8,683,645 B2
(45) Date of Patent: Apr. 1, 2014

(54) VACUUM CLEANING DEVICE WITH AIR QUALITY MONITORING SYSTEM

(75) Inventor: Ellen Tave Glassman, Closter, NJ (US)

(73) Assignee: Sears Brands, L.L.C., Hoffman Estates, IL (US)

( * ) Notice: Subject to any disclaimer, the term of this patent is extended or adjusted under 35 U.S.C. 154(b) by 643 days.

(21) Appl. No.: 12/841,592

(22) Filed: Jul. 22, 2010

(65) Prior Publication Data

US 2012/0017389 A1 Jan. 26, 2012

(51) Int. Cl.
*A47L 7/00* (2006.01)

(52) U.S. Cl.
USPC ..... 15/339; 15/319

(58) Field of Classification Search
USPC ..... 15/339, 319
See application file for complete search history.

(56) References Cited

U.S. PATENT DOCUMENTS 4,580,311 A 4/1986 Kurz
5,515,572 A 5/1996 Hoekstra et al.
5,542,146 A * 8/1996 Hoekstra et al. ..... 15/319
6,029,309 A * 2/2000 Imamura ..... 15/319
6,111,501 A 8/2000 Honeyager et al.
6,484,352 B2 11/2002 Huebsch et al.
7,302,313 B2 11/2007 Sharp et al.
7,650,668 B2 1/2010 Kim
2007/0180648 A1 * 8/2007 Andrup et al. ..... 15/339

OTHER PUBLICATIONS

Canadian Intellectual Property Office, Office action in Application No. 2,744,650, dated Aug. 20, 2013.

* cited by examiner

*Primary Examiner* — Charles A Fox
*Assistant Examiner* — Patrick Maestri
(74) *Attorney, Agent, or Firm* — McAndrews, Held & Malloy, Ltd.

(57) ABSTRACT

An air quality monitoring system is associated with a housing of a vacuum cleaner and includes at least one sensor for measuring data of an air quality parameter and a display, such as a color screen, for presenting information regarding the air quality parameter that is measured by the at least one sensor. The air quality monitoring system may be a self contained unit that may be removed from the housing of the vacuum cleaner or may be included as an integral part of the vacuum cleaner.

8 Claims, 2 Drawing Sheets

VACUUM CLEANING DEVICE WITH AIR QUALITY MONITORING SYSTEM

BACKGROUND

Vacuum cleaning devices are know in the art. Generally, a vacuum cleaning device is comprised of at least six components, namely, an intake port, an exhaust port, an electric motor, a fan, a filter and/or a vacuum bag, and a housing in which the components are formed/carried. As will be understood, when a vacuum cleaning device is turned on, the electric motor operates to rotate the fan and, as the blades of the fan are rotated, air is forced towards the exhaust port which creates a pressure drop behind the fan thereby creating a vacuum inside the housing. As a result of the vacuum created inside the housing, air pushes itself into the vacuum cleaner through the intake port and, for as long as the fan is running and the passageway through the vacuum remains open, a constant stream of air will move through the intake port and out the exhaust port. As will be additionally appreciated, some vacuum cleaner designs also have rotating brushes at the intake port which function to kick dust and dirt loose from a surface, such as a carpet, so it can be picked up by the air stream. As the dust and dirt-filled air makes its way to the exhaust port, it is passed through the filter and/or vacuum bag where the air passes through tiny holes formed therein while the dust and dirt particles are captured thereby. The filter and/or vacuum bag can be positioned anywhere along the path between the intake port and the exhaust port as long as the stream of air flows therethrough. In vacuum cleaners of the upright type the filter and/or vacuum bag is typically located after the fan and adjacent to the exhaust port while in vacuum cleaners of the canister type the filter and/or vacuum bag is typically located before the fan and adjacent to the inlet port.

Particular examples of vacuum cleaning devices may be seen in U.S. Pat. Nos. 7,650,668, 6,484,352, and 5,515,572 which patents, for the sake of brevity of disclosure, are incorporated herein by reference in their entirety.

SUMMARY

The subject disclosure is directed to an improved vacuum cleaning device having an air quality monitoring system. The air quality monitoring system may be integrated into the design of the housing of the vacuum cleaning device or may be a component that is detachably mated to the housing of the vacuum cleaning device. The air quality monitoring system includes at least one sensor for measuring data of an air quality parameter and a display, such as a color screen, for presenting information regarding the air quality parameter that is measured by the at least one sensor.

A better understanding of the objects, advantages, features, properties and relationships of the subject vacuum cleaning device will be obtained from the following detailed description and accompanying drawings which set forth an illustrative, preferred embodiment indicative of the various ways in which the principles of the invention may be employed.

BRIEF DESCRIPTION OF THE DRAWINGS

For a better understanding of the vacuum cleaning device with air quality monitoring system described hereinafter described reference may be had to the following drawings in which.

DETAILED DESCRIPTION

Figure 1:
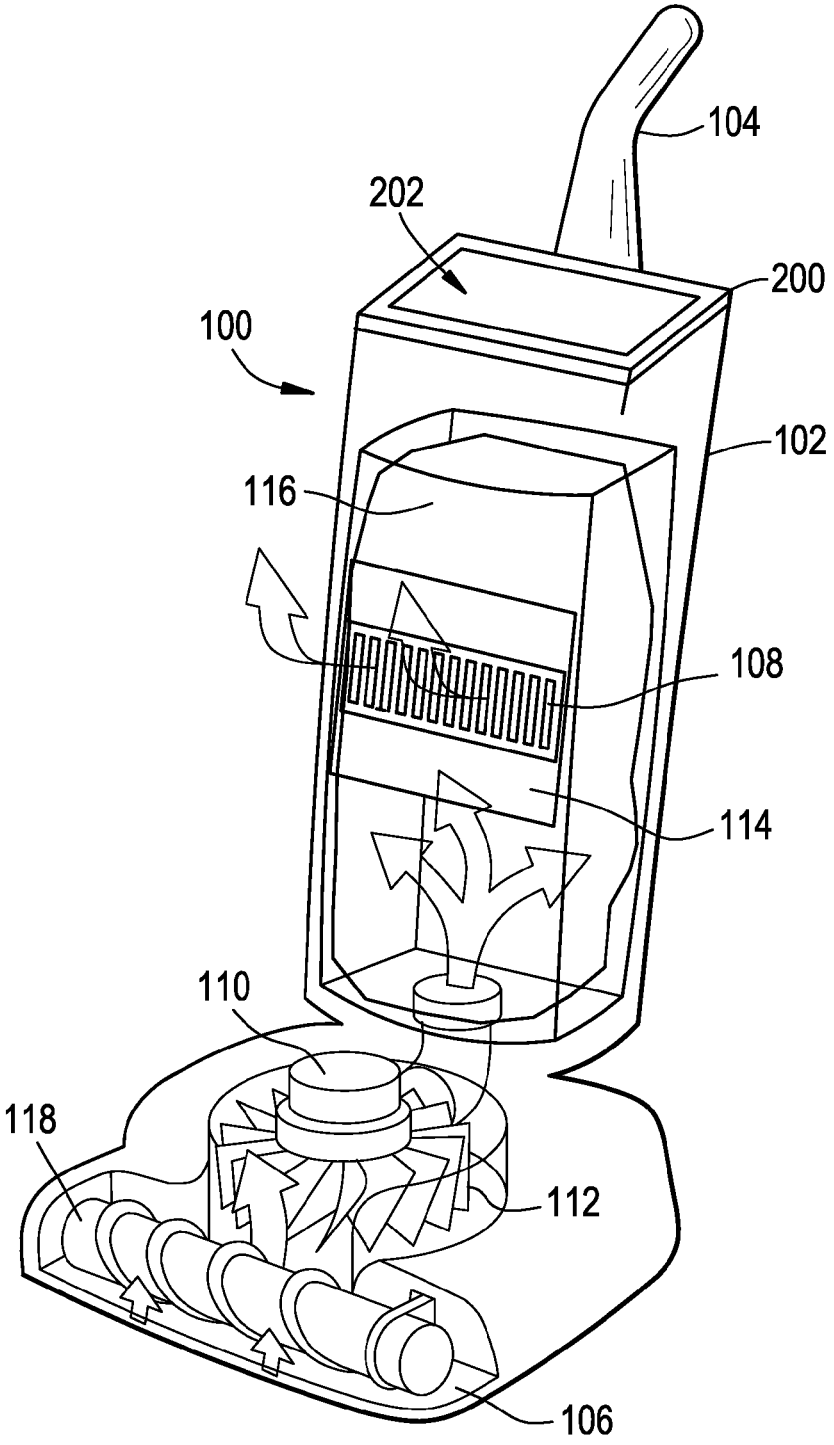
FIG. 1 illustrates an exemplary vacuum cleaning device including an exemplary air quality monitoring system.

With reference to FIG. 1, the following describes an improved vacuum cleaning device 100 having an associated air quality monitoring system 200. While the vacuum cleaning device 100 is illustrated in the exemplary form of a vacuum cleaner of the upright type, it is to be appreciated that the vacuum cleaning device 200 may of the canister type or any other type without limitation. As further shown in FIG. 1, the air quality monitoring system 200 is preferably located at a position, such as at a top of a housing 102 of the vacuum cleaning device 100 near an operator handle 104, whereby a display 202 of the air monitory system 200 will be visible to a user during operation of the vacuum cleaning device 100. In this regard, the air quality monitoring system 200 may be integrated into the design of the housing 102 of the vacuum cleaning device 100 or may be a component that is detachably mated to the housing 102 of the vacuum cleaning device 100, for example, via use of a conventionally known docking mechanism. In the event that the air quality monitoring system 200 is a component that is detachably mated to the housing 102 of vacuum cleaning device 100, the air quality monitoring system 200 may have its own power supply 204 which may be a conventional battery or a battery that is rechargeable when the air quality monitoring system 200 is docked with the vacuum cleaning device 100. As will be described in greater detail below, the air quality monitoring system includes at least one sensor 206 for measuring data of an air quality parameter as well as the display 202, such as a color LCD screen or the like, for presenting information regarding the air quality parameter that is measured by the at least one sensor 206.

As shown in FIG. 1, the vacuum cleaning device 100 is of conventional design and includes of an intake port 106, an exhaust port 108, an electric motor 110, a fan 112, a filter 114 and/or a vacuum bag 116, and the housing 102 in which the components are formed/carried. As previously discussed, when the vacuum cleaning device 100 is turned on, the electric motor 110 operates to rotate the fan 112 and, as the blades of the fan 112 are rotated, air is forced towards the exhaust port 108 which creates a pressure drop behind the fan 112 thereby creating a vacuum inside the housing 102. As a result of the vacuum created inside the housing 102, air pushes itself into the vacuum cleaning device 100 through the intake port 106 and, for as long as the fan 112 is running and the passageway through the vacuum cleaning device 100 remains open, a constant stream of air will move through the intake port 106 and out the exhaust port 108. As was also previously discussed, some types of vacuum cleaner devices also have rotating brushes 118 at the intake port 106 which function to kick dust and dirt loose from a surface, such as a carpet, so it can be picked up by the air stream. As the dust and dirt-filled air makes its way to the exhaust port 108, it is passed through the filter 114 and/or vacuum bag 116 where the air passes through tiny holes formed therein while the dust and dirt particles are captured thereby. The filter 114 and/or vacuum bag 116 can be positioned anywhere along the path between the intake port 106 and the exhaust port 116 as long as the stream of air flows therethrough. In upright vacuum cleaners the filter 114 and/or vacuum bag 116 is typically located after the fan 112 and adjacent to the exhaust port 108 while in canister vacuum cleaners the filter 114 and/or vacuum bag 116 is typically located before the fan 112 and adjacent to the inlet port 106.

Figure 2:
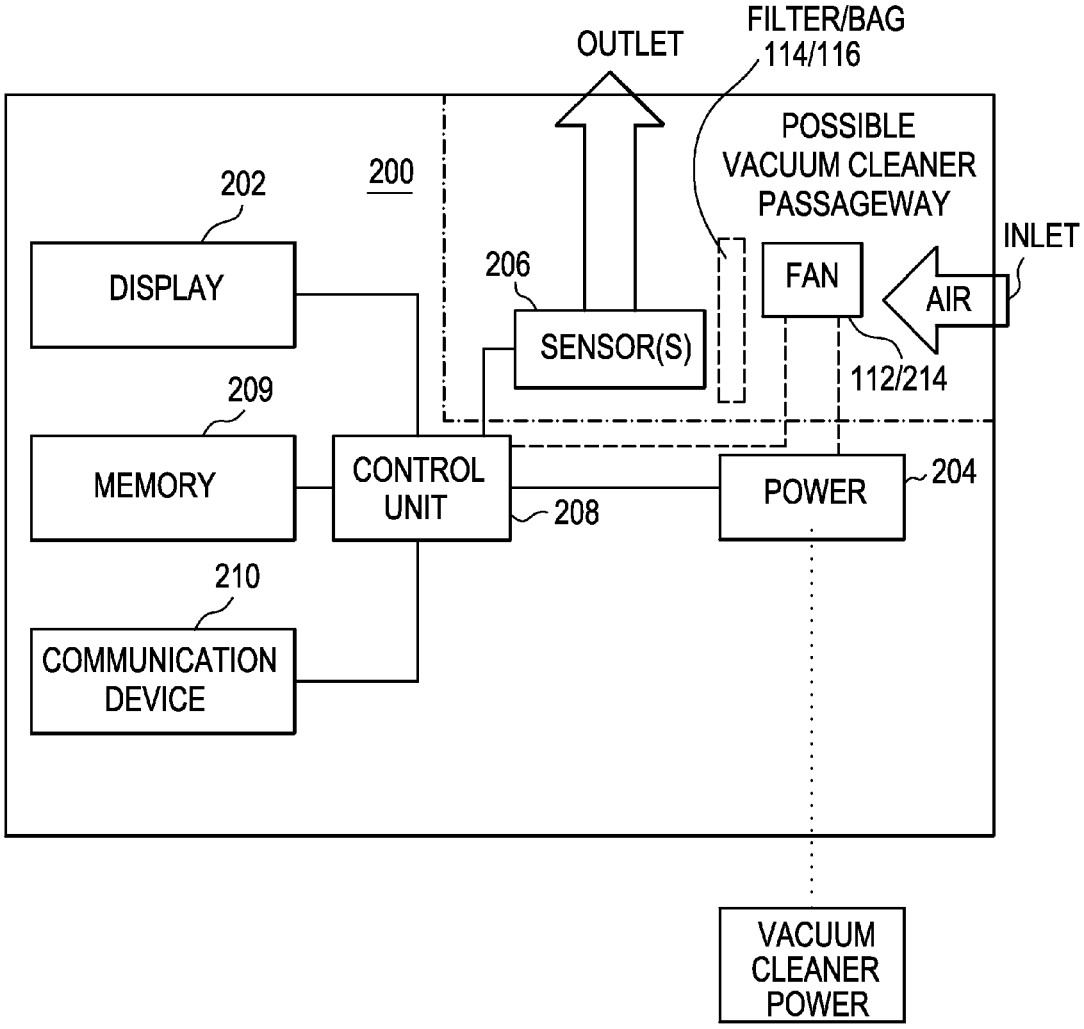
FIG. 2 illustrates exemplary components of the air quality monitoring system of FIG. 1.

Turning now to FIG. 2, exemplary components of the air quality monitoring system 200 are illustrated. Generally, the air quality monitoring system 200 includes one or more sensor units 206 connected to a control unit 208 having an associated physical memory device 209, such as a RAM, ROM, and/or the like, in which is stored instructions for operating the air quality monitoring system 200 and in which parameter data read by the sensor unit(s) 206 may be stored. The control unit 208 is, in turn, connected to the display 202. While not required, the control unit 208 may be connected to a communication device 210 whereby parameter data read by the sensing unit(s) 206 and stored in the memory device 209 may be downloaded to a personal computer, provided to a server via the Internet, or the like for further analysis. Similarly, via the communication device 210 instructions for upgrading any software/firmware stored on the memory device 209 may be provided to the air quality monitoring system 200. Thus, it will be appreciated that the communication device 210 may take the form of a wireless and/or wired transceiver. A power supply 204, such as a battery, is additionally provided for powering the various system components. In the event that the air quality monitoring system 200 is integrated into the housing 102 of the vacuum cleaning device 100, the power supply 200 need not be in the form of a battery. Rather, the components of the air quality monitoring system 200 may be provided power via the power supply that is used to provide power to the components of the vacuum cleaning device 100. In the event that the power supply 204 is a rechargeable battery, i.e., for use in a connection with an air quality monitoring system 200 that is detachable from the housing 102 of the vacuum cleaning device 100, the air quality monitoring device 200 may be provided with contacts that are matable with corresponding contacts of the vacuum cleaning device 100 and/or a recharging station by which a recharging current can be provided to recharge the battery.

As will be further appreciated, the sensor(s) 206 of the air quality monitoring system 200 are disposed in one or more air passageways having an air inlet and an air outlet whereby the sensor(s) 206 have access to air to be sampled. In this regard, the air passageway may be a shared air passageway with the vacuum cleaning device 100 and the sensor(s) 206 may thus be positioned before or after the filter 114 and/or vacuum bag 116 (individually and collectively an "air filtration mechanism") of the vacuum cleaning device 100 as desired. Alternatively, especially in the case of an air quality monitoring device 200 that is to be useable separate and apart from the vacuum cleaning device 100, the air quality monitoring system 200 may include a fan 214 that is associated with an air passageway that is formed in the housing of the air quality monitoring whereby the fan 214 similarly functions to create a vacuum by which air is drawn into the air passageway for sampling by the sensor(s) 206.

Considering now the sensor(s) 206, the sensor(s) 206 may be integrated with or be a replaceable/interchangeable part of the air quality monitoring system 200. The sensor(s) 206 may be used to measure environmental and/or air quality parameters, such as temperature, humidity, barometric pressure, ozone level, particle concentrations, radon, carbon monoxide, or the like. For the sake of brevity, examples of sensors for measuring such environmental and/or air quality parameters may be found in U.S. Pat. No. 7,302,313 which is incorporated herein by reference in its entirety. In this manner, during operation of the air quality monitoring system 200—which may be in response to activation of a separate on/off switch provided to the air quality monitoring system 200 or as part of operation of the vacuum cleaning device 100—the control unit 208 will receive signals from the sensor(s) 206 and the operating program(s) of the control unit 208 may analyze the results of the measurement(s) indicated by the received signals and thereby cause the display 202 to display information concerning the measurement(s), such as values associated with the parameters being measured, graphs, textual warnings, proposed solutions to any sensed problems, possible causes of any sensed problems, and/or the like. In addition, a device for generating a sound may be provided with the air quality monitoring system 200 to draw the attention of a user to the display 202 as necessary, e.g., the air quality monitoring system 200 can function as a carbon monoxide and/or smoke detector when in a passive mode when the air quality monitoring system 200 (or the vacuum cleaner as applicable) is plugged in to an outlet or otherwise receiving power via a battery. Thus, it will be appreciated that the air quality monitoring system 200 may include a program or a combination of programs that uses rule based, case based, or pattern recognition methods, or a combination of these methods to analyze data and make decisions and recommendations based on one or more of user supplied information, environmental data, such as weather, and measured air quality parameter data. Alternatively, or in addition, the air quality monitoring system 200 may use fuzzy logic, neural networks, or other AI techniques to analyze data or make decisions. The basis of the rules on which the air quality monitoring system 200 may be a combination of knowledge supplied by experts or by experience that air quality monitoring system 200 achieves through feedback as to the accuracy of its analysis or decisions.

While specific examples of a vacuum cleaning device including an air quality monitoring system have been described in detail, it will be appreciated by those skilled in the art that various modifications and alternatives to those details could be developed in light of the overall teachings of this disclosure. Accordingly, the particular arrangements disclosed are meant to be illustrative only and not limiting as to the scope of the invention which is to be given the full breadth of the appended claims and any equivalents thereof.

What is claimed is:

1. A vacuum cleaning device, comprising:

a housing having an air passageway, the air passageway having an air inlet and an air outlet;

a device for creating a vacuum in the air passageway;

an air filtration mechanism disposed in the air passageway for cleaning air drawn through the air passageway by the created vacuum; and an air quality monitoring system comprising a sensor for measuring data of an air quality parameter, a control unit for evaluating the air quality parameter, and a display for presenting information with respect to the evaluation of the air quality parameter;

wherein the sensor is located in the air passageway behind the air filtration mechanism, wherein the display is positioned on the housing of the vacuum cleaning device at a location whereby the display is viewable to a user of the vacuum cleaning device, wherein the air quality monitoring system is removeably attached to the vacuum cleaning device.

2. The vacuum cleaning device as recited in claim 1, wherein the air quality monitoring system comprises a housing having an air passageway, wherein a fan is disposed in the air passageway of the air quality monitoring system, and wherein the sensor is disposed in the air passageway of the air quality monitoring system.

3. The vacuum cleaning device as recited in claim 2, wherein the air quality monitoring system comprises a battery for providing power to one or more of the fan of the air quality monitoring system, display, and control unit and wherein the battery is rechargeable when the air quality monitoring system is docked to the vacuum cleaning device.

4. The vacuum cleaning device as recited in claim 1, wherein the air quality monitoring system comprises a communications device whereby air quality parameter data measured by the sensor is downloadable to an external device from the air quality monitoring system.

5. The vacuum cleaning device as recited in claim 4, wherein the communications device comprises a wireless transceiver.

6. The vacuum cleaning device as recited in claim 4, wherein the air quality monitoring system is removeably attached to the vacuum cleaning device.

7. The vacuum cleaning device as recited in claim 6, wherein the air quality monitoring system comprises a housing having an air passageway, wherein a fan is disposed in the air passageway of the air quality monitoring system, and wherein the sensor is disposed in the air passageway of the air quality monitoring system.

8. The vacuum cleaning device as recited in claim 7, wherein the air quality monitoring system comprises a battery for providing power to one or more of the fan of the air quality monitoring system, display, and control unit and wherein the battery is rechargeable when the air quality monitoring system is docked to the vacuum cleaning device.

* * * * *